US005988073A

United States Patent [19]

Eriksson

[11] Patent Number: 5,988,073

[45] Date of Patent: Nov. 23, 1999

[54] RAILWAY WAGGON

[76] Inventor: Jan Eriksson, Backen 2834 A, Nälden S-830 44, Sweden

[21] Appl. No.: 08/952,434

[22] PCT Filed: Apr. 2, 1996

[86] PCT No.: PCT/SE96/00429

§ 371 Date: Nov. 18, 1997

§ 102(e) Date: Nov. 18, 1997

[87] PCT Pub. No.: WO96/37396

PCT Pub. Date: Nov. 28, 1996

[30] Foreign Application Priority Data

May 26, 1995 [SE] Sweden ..... 9501954

[51] Int. Cl.[6] ..... B61D 3/00

[52] U.S. Cl. ..... 105/355; 105/370; 104/29; 104/30; 104/31

[58] Field of Search ..... 105/455, 28, 355, 105/370; 104/29, 30, 31; 410/1; 414/333

[56] References Cited

FOREIGN PATENT DOCUMENTS

| | | | |
|---|---|---|---|
| 0 023 372 | 7/1980 | European Pat. Off. . | |
| 0 207 491 | 10/1989 | European Pat. Off. . | |
| 0 293 359 | 7/1990 | European Pat. Off. . | |
| 0 528 741 | 8/1992 | European Pat. Off. . | |
| 0 584 026 | 8/1993 | European Pat. Off. . | |
| 0 622 284 | 4/1994 | European Pat. Off. . | |
| 3234374 | 9/1982 | Germany | 410/1 |
| 3234375 | 3/1984 | Germany | 410/1 |
| 4112995 | 11/1992 | Germany . | |
| 82061813 | 11/1982 | Sweden . | |
| 451 612 | 10/1987 | Sweden . | |
| 9001832 | 5/1990 | Sweden . | |
| 2198405 | 11/1987 | United Kingdom . | |
| WO81/02142 | 8/1981 | WIPO . | |

OTHER PUBLICATIONS

Pamphlet, Trommelbremse fur Schienenfahrzeuge Leise Sicher und Wirtschaftlich ABB Henschel Waggon Union GmbH, Thyssen Bergische Stahlindustrie & Vereinigte Schmiedewerke GmbH.

*Primary Examiner*—Robert J. Oberleitner
*Assistant Examiner*—Robert J. McCarry, Jr.

[57] ABSTRACT

A railway waggon comprises on one hand a load carrier (2) composed of two carrying beams (12, 12') and an intermediate, load-receiving platform part (13), and on the other hand bogies (3) with wheels (4) for railway tracks (5). The platform part (13) is located on level with or below the carrying beams (12, 12'), which at their ends change into jibs (15, 15') located above the beams so that these may be applied on top of the bogies (3), without the platform (13) being markedly distanced vertically from the wheel base of the bogies. The load carrier (2) is on one hand coupled to the bogie via a joint (25, 26) in order to allow for relative turning motions between the bogie and the load carrier, and on the other hand detachably connected with each one of the bogies, in order to, in an inactive state in connection with loading and unloading, be able to be displaced with each end laterally. In this way, a removal of the load carrier to a laterally pivoted position is allowed for, in which a vehicle may be driven on and off the platform part in the area between the carrying beams (12, 12') of the load carrier.

7 Claims, 5 Drawing Sheets

RAILWAY WAGGON

TECHNICAL FIELD OF THE INVENTION

This invention relates to a railway waggon comprising on one hand a load carrier composed of at least two separate carrying beams and a platform part extending therebetween, and on the other hand front and rear bogies having wheels for railway rails or railway tracks, the platform part being located on level with or below the carrying beams, which at their opposed ends change into jibs located on a higher level than the beams per se, in order to be applied on top of the bogies, without markedly distancing the platform part vertically from the wheel base of the bogies, the load carrier being detachably connected with each one of the bogies in order to, in an inactive state in connection with loading and unloading, be displaceable with each end laterally relative to an imaginary geometrical longitudinal axis between the bogies, so that in this way a removal of the load carrier is made possible to a position distanced from the bogie or bogies, in which position a vehicle may be driven on and off the platform part in the area between the carrying beams of the load carrier.

BACKGROUND OF THE INVENTION AND PRIOR ART

Modern logistics rely to an increasing extent upon combined railway and road transports. Thus, a common way of distributing goods is to transport the goods a shorter distance in a near region on a lorry set to an existent railway, where the lorry set in its entirety is loaded upon a railway waggon comprised in a train unit, which in turn is driven a longer distance to the proximity of the place of destination, whereafter the lorry set is unloaded and driven a shorter distance on the road to the receiver. Combined railway and road transports of this type necessitate specially built railway waggons to fulfil the railway norms for train units. More specifically, the railway waggons must be constructed in such a way that the whole carriage with the on-loaded lorry manages the so called standard profile cross-section which is used to determine whether a train unit is able to pass, e.g., tunnels, subway crossings, short radius curves, etc.

The proposals for railway waggons for the above mentioned purposes are many and abundantly described in the patent literature. Hitherto disclosed constructions may be divided into two main categories, namely a first category that is based on the principle of driving the load vehicles one after the other onto a train unit, starting at one end of the train unit, the first road vehicle being driven along the train unit from one end to the other, and a second category that makes use of some sort of platform built upon the chassis of the railway waggon, said platform being turnable or pivotable relative to the chassis. Examples of railway waggons belonging to the first category are described in DE 41 12 995 and EP 293 359. Examples of waggons belonging to the second category are described in GB 2 198 405, EP 207 491 and SE 8206181-3.

In practice, a disturbing drawback of the railway waggons of the first category is that an arbitrary road vehicle cannot separately be driven off the train unit, i.e., a given road vehicle cannot be removed from the train unit without that either the vehicle in front of or at the back of the same has first been driven off the train unit. This drawback is not inherent in the railway waggons of the second category, in that individual platforms may be pivoted or turned relative to the appurtenant waggon without any connection with other waggons in the train unit, but in return of this such railway waggons have other serious disadvantages. Thus, long road vehicles may not be driven on and off the railway waggon without the platform protruding a considerable distance from the side or sides of the waggon. Moreover, the platform per se adds to the height; a fact that either involves that the waggon has to be equipped with costly arrangements for raising and lowering the platform relative to the waggon chassis, or that the railway waggon has to be made with extremely small wheels in order to manage the previously mentioned standard cross-sectional profile. However, small wheels restrict the maximal speed of motion of the railway waggon.

OBJECTS AND CHARACTERISTICS OF THE INVENTION

The present invention aims at removing the above mentioned disadvantages of previously known railway waggons for combined railway and road transports and providing an improved waggon. Thus, a primary object of the invention is to provide a railway waggon that makes possible to drive on and off both short and long road vehicles or carriages without any help of special, turnable or pivotable platforms and without any connection with adjacent waggons in the train unit. A further object is to provide a railway waggon that makes it possible to drive off a road vehicle in the same direction as when driving it on. In other words, it shall not be necessary to reverse an onloaded road vehicle when driving it off. Still another object of the invention is to provide a railway waggon that is simple in its construction and is allowed to comprise bogies with adequately large wheels in spite of the possibility of individual, rational on- and off-driving of the road vehicles. It is also an object to provide a railway waggon that makes possible an individual loading and unloading of the road vehicles without any complicated external facilities. Thus, it shall be possible to load a road vehicle on and unload it off the waggon at arbitrary locations along a railway track. It is also an object to provide a waggon that manages to transport extremely long lorry sets, i.e., sets comprising not only a pulling vehicle, but also a long trail car.

According to the invention, at least the primary object is attained by the features that are defined in the characterizing clause of claim 1. Further, advantageous embodiments of the invention are defined in the dependent claims.

FURTHER ELUCIDATION OF THE PRIOR ART

From WO 81/02 142 a railway waggon is previously known of the type related to in the preamble. However, this railway waggon lacks any type of intermediate part between the jibs of the load carrier and the individual bogie, and the load carrier is connected with the bogies via locking bolts that are insertable into recesses in the bogies, more specifically in connection with their outer corners. In practice, this means that the railway waggon becomes unusable for driving on anything else than straight tracks. Contrary to this, the joint between the intermediate part according to the invention and the bogie makes a free mobility possible between the bogie and the load carrier and thus a cornering in connection with factual driving.

BRIEF DESCRIPTION OF THE APPENDED DRAWINGS

In the drawings

FIG. 1 is a schematic side view of a railway waggon according to the invention, with an on-loaded lorry set, FIG. 2 is a view from above of the waggon according to FIG. 1, FIG. 3 is a partial side view showing the coupling of two waggons included in a train unit, FIG. 4 is an enlarged cross-section of a load carrier of a railway waggon according to the invention, FIG. 5 is a perspective, exploded view showing a bogie comprised in the waggon, an end of the load carrier of the waggon and an intermediate part operating between the load carrier and the bogie, and FIGS. 6 to 10 are plane views illustrating different application possibilities for the waggon according to the invention.

DETAILED DESCRIPTION OF A PREFERRED EMBODIMENT OF THE INVENTION

Figure 1:
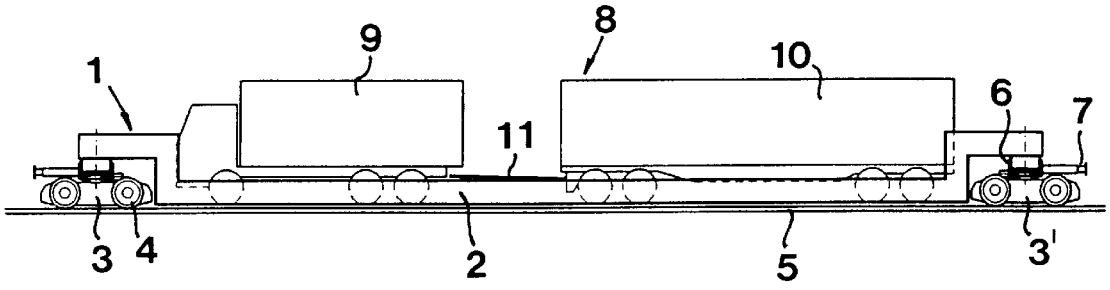
Figure 2:
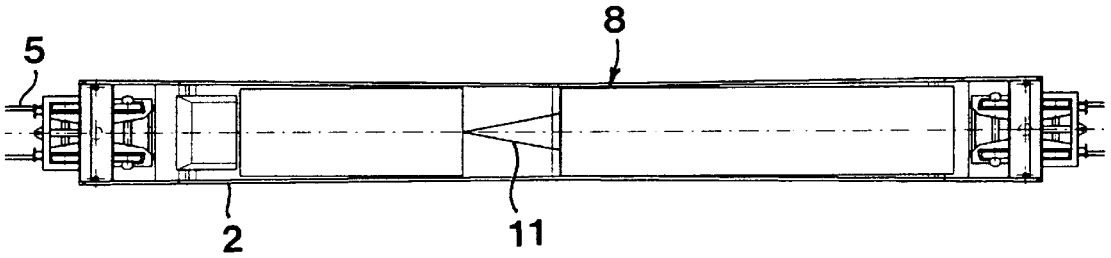
Figure 3:
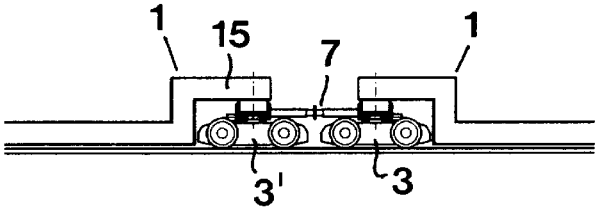

In the drawings, reference numeral 1 generally designates a railway waggon, which includes on one hand a load carrier 2 and on the other hand two bogies 3, 3', each one of which comprising at least four wheels 4 intended to run along a railway track 5 in the form of two separate rails. Between the individual bogie 3 and the load carrier 2 operates an intermediate part designated 6, which comprises coupling means 7 for the coupling of the individual railway waggon with other waggons in order to form a train unit. In FIG. 1 and 2 is shown a lorry set designated 8 in its entirety, which is parked on the railway waggon 1. According to the example, the lorry set 8 comprises both a pulling vehicle 9 and a trailer 10. The units 9, 10 are coupled with each other via a pulling arrangement 11. In this context it should be emphasized that any objects may be loaded on the waggon 1, e.g. other wheel or crawler-type vehicles, piece goods, particle shape materials, etc. Therefore, depending on the field of use, the load carrier 1 may also include a suitable superstructure, although such one is not illustrated in the drawings.

Figure 4:
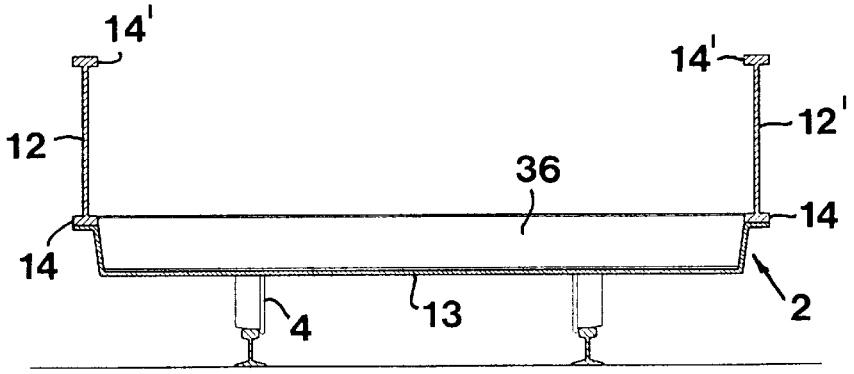

In FIG. 4 may be seen schematically how the load carrier 2 is composed of two separate carrying beams 12, 12' and a bottom or platform part 13 extending between them, said part forming the load surface on which the vehicle 8 is received. As may be clearly seen in FIG. 4, the platform part 13 is situated low relative to the carrying beams 12, 12'. More specifically, the platform part 13 in the example is situated on a level below the lower flanges 14 of the beams. However, in this context it should be underlined that it is also feasible to place the platform part 13 on a higher level relative to the beams than the shown one. Thus, it is possible to place the platform part 13 about on equal level with the lower flanges 14 or even somewhat higher than these. However, under all circumstances the platform part 13 should be located closer to the lower flanges 14 than to the upper flanges 14'.

Figure 5:
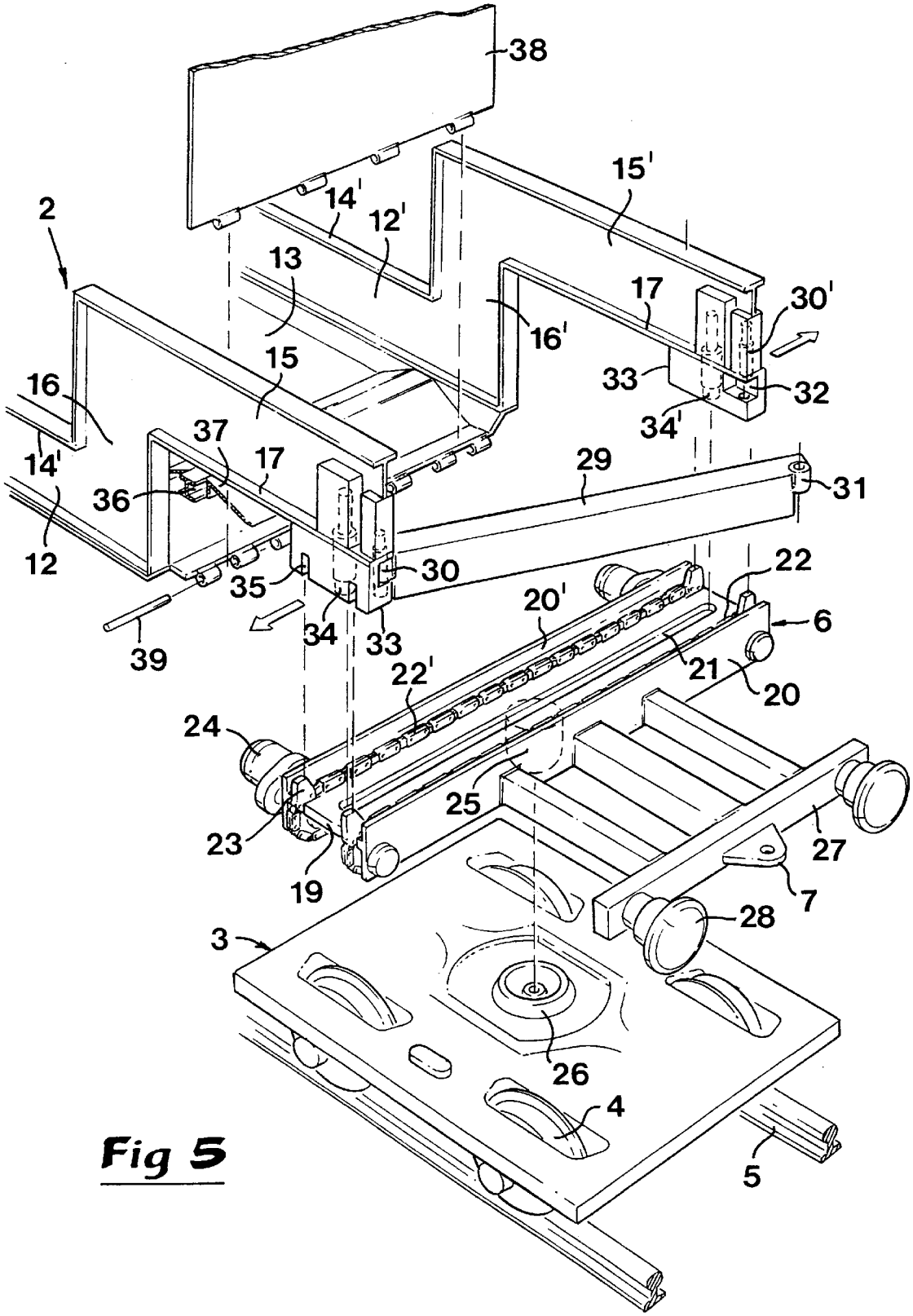

Reference is now made to FIG. 5 which illustrates how the beams 12, 12' at opposite ends change into special jibs 15, 15', which are raised or situated on a higher level in relation with the beams per se. In the shown example, the height of the jibs is determined relative to the beams by vertically extending transition portions 16, 16' which like the beam and the jib, comprise a central web and opposed flanges. Though the height of the individual jib over the beam may vary, the height difference according to the example shown in FIG. 5 is such that the lower flange 17 of the jib is located in a horizontal plane above the upper flange 14' of the carrying beam. In this context it should be pointed out that the carrying beams 12, 12'0 per se have a considerable length (e.g., within the range of 20 to 26 meters). Therefore, they should be preloaded to stand the stresses of such heavy objects as a fully loaded lorry set. It should also be pointed out that the beams in the region right between their opposite ends may be somewhat reduced, while forming a slight waist at the middle of the waggon, i.e., the beams shall be slightly arched (concave towards the outside). In this way, a reliable cornering is guaranteed also at short radius curves along the track.

Between the bogie 3 and the jibs 15, 15' is arranged a cradle-like intermediate part designated 6 in its entirety, which is long and narrow and transverse relative to the longitudinal direction of the waggon. According to the example, the intermediate part 6 is composed of a rectangular, lying plate 19 which along its long side edges is connected with two vertical flanges 20, 20'. In the framework-forming strong plate 19 is recessed a central long and narrow groove 21 whose length is smaller than that of the plate. In other words, the groove ends at a distance from the short ends of the plate. The top side of the plate 19 serves as a sliding surface for two endless chains 22, 22' which are provided with shoulder-shaped carriers 23. More specifically, each chain should comprise two carrier shoulders, as shown in FIG. 5. The chains are reversibly drivable by means of one or several motors 24, e.g. in the form of electrical or hydraulic motors. In other words, the upper parts of the chains may be driven forwards over the sliding surface in either of two opposite directions.

On the underside of the plate or the intermediate part is arranged a downwardly extending pivot or similar, male-like protrusion 25 that engages into a female-like seat 26 on the top side of the bogie 3. Thus, the pivot 25 forms a joint that makes possible a pivoting or turning of the intermediate part 6 relative to the bogie. On the outside of the flange 20 are welded a number of box sections which together carry a cross piece 27 with shock absorbers 28 and coupling means 7 which have the form of a lug with a hole, which allows for an inter-coupling of the intermediate part 6 with a corresponding intermediate part of an adjacent waggon.

Between the jibs 15, 15' is arranged a cross springer 29 which at its opposed ends is connected with the jibs via a couple of dowels 30, 30'. These dowels are built-in in a housing and cooperate with a lifting mechanism, e.g. in the form of a magnetic valve or a hydraulic cylinder, by means of which the dowels may be moved vertically between upper and lower end positions. At the ends of the cross springer 29 are sleeves 31, which can be introduced into recesses 32 of a block 33 located on the underside of the individual jib. When the individual dowel 31 in a lower end position engages into the sleeve 31, the jib serves as a combined lock and joint element. When one of the two dowels 30, 30' is moved to its upper end position, the appurtenant end of the cross springer 29 is liberated, which then may be pivoted relative to the other dowel. Furthermore, in each block 33 is built-in a further dowel 34, 34' which in a similar way is vertically mobile by means of a suitable lifting mechanism. In a lower end position, the individual dowel 34, 34' engages into the groove 21 to lock the load carrier 2 relative to the intermediate part 6. In its upper end position, the dowel 34, 34' is liberated from the groove 21, whereby the appurtenant jib 15, 15' becomes free to move outwards from the framing plate 19. In this context it should be pointed out that the dowels 34, 34' should have a diameter that is smaller than the width of the groove 21, in order to make possible a slightly arched motion path for a dowel that is moved along the groove.

In each individual block 33 are external recesses 35 for accomodating the carrier shoulders 23. It should be observed that the axial extension or length of the blocks 33 substantially tallies with the distance between the two flanges 20, 20'. Thus, the blocks form connecting elements that absorb pulling and pushing forces, said elements being between the load carrier 2 and the intermediate part 6.

In FIG. 5 it may be seen how the load carrier construction formed by the beams 12, 12' and the bottom 13 is stiffened by transverse beams 36, e.g. in the form of I-beams. As may be seen in, e.g., FIG. 6, three such cross beams 36 may be arranged between the carrying beams, viz. one at each end of the load carrier and one in the middle. Advantageously, at both sides of each cross beam 36 may be arranged access ramp-like plates 37 in order to facilitate the driving-through of vehicle wheels. At the end of the bottom-forming platform part is arranged a gate 38 which via a leading arrangement 39 is foldable between a raised position and a lowered position, in which driving on and off is simplified in spite of possible height differences between the platform part and the surrounding ground or bedding.

From the above description, it should be clearly understood that relative turning motions between the bogies and the load carrier are possible at the same time as each end of the load carrier is detachably connected with each one of the bogies.

In FIG. 6 to 10 different possibilities of use of the railway waggon according to the invention are illustrated.

Figure 6:
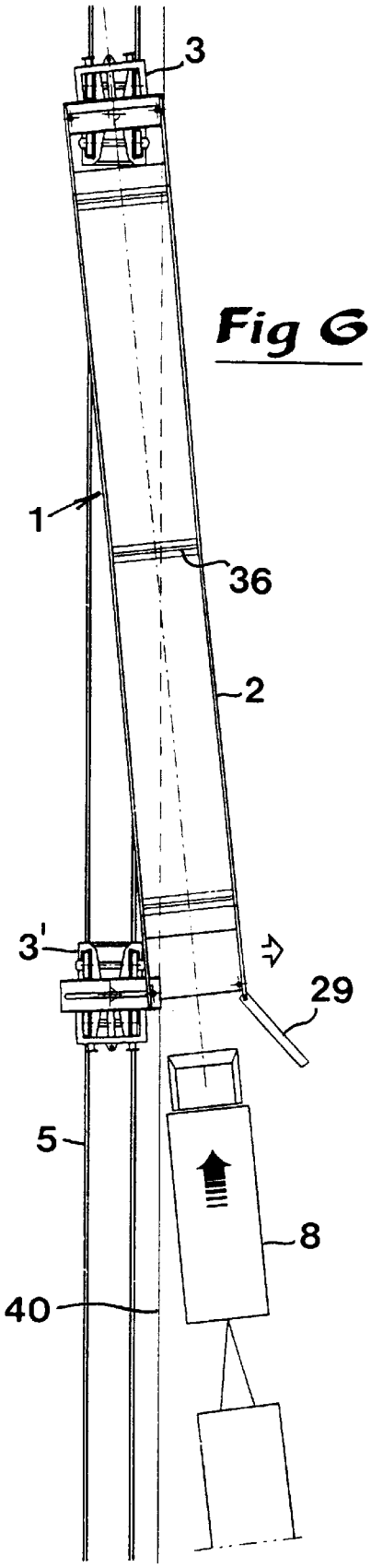

In FIG. 6 is shown how the road vehicle 8 may be driven upon the waggon 1 from a railway platform designated 40. Then the two bogies 3, 3' of the waggon are placed upon the railway track 5 at the same time as the load carrier 2 has been pivoted outwards. In order to make possible this pivoting outwards, it is proceeded in the following way (see again FIG. 5). In a first step, one of the two dowels 34, 34' is inactivated so that the appurtenant jib may freely move outwards from the framing plate 19. Thereafter, the feeding chains 22, 22' are started, whose rear carrier shoulders 23 carry the adjacent block 33, while the end in question of the load carrier 2 is displaced laterally relative to the bogie in question. During this lateral displacement, the cross springer 29 bears against the chain 22 and counteracts tilting tendencies of the end of the load carrier when it approaches its outer end position. In this context, it should be pointed out that the bottom 13 of the load carrier as such may be supported in a suitable way during its lateral motion, e.g. by means of special roller devices or slide bars placed on the railway platform. After that the end of the load carrier has been laterally moved in this way to an outer end position that is determined by the one of the dowels 34, 34' that is still in engagement with the groove 21, the cross springer 29 is pivoted outwards to a position in which it does not obstruct the driving-on of the vehicle 8. Such a pivoting of the cross springer 29 is possible since one of the two dowels 30, 30' has been raised to an upper end position. In this condition, the vehicle 8 may be driven upon the platform or bottom part 13 of the load carrier, with its wheels resting on the top side of said part, which side serves as a loading area. By the fact that the load carrier 2 has a considerable length, a very long lorry set in the form of a pulling vehicle as well as a trail car may be accomodated on the load carrier. After that the vehicle or carriage has been parked on the load carrier, the latter is pivoted back to its original position according to FIG. 2. This is accomplished by reversing the drive of the chains 22, 22', after that the cross springer 29 first has been returned to a normal position in which the two dowels 30, 30' lock it. In a terminating step, the load carrier is locked relative to the bogie by moving the the dowel 34, 34' in question to its lower end position, in which it engages into the groove 21. Then the two lowered dowels 34, 34' make a lateral displacement of the load carrier relative to the intermediate part 6, and thereby also to the bogie 3, impossible.

Figure 7:
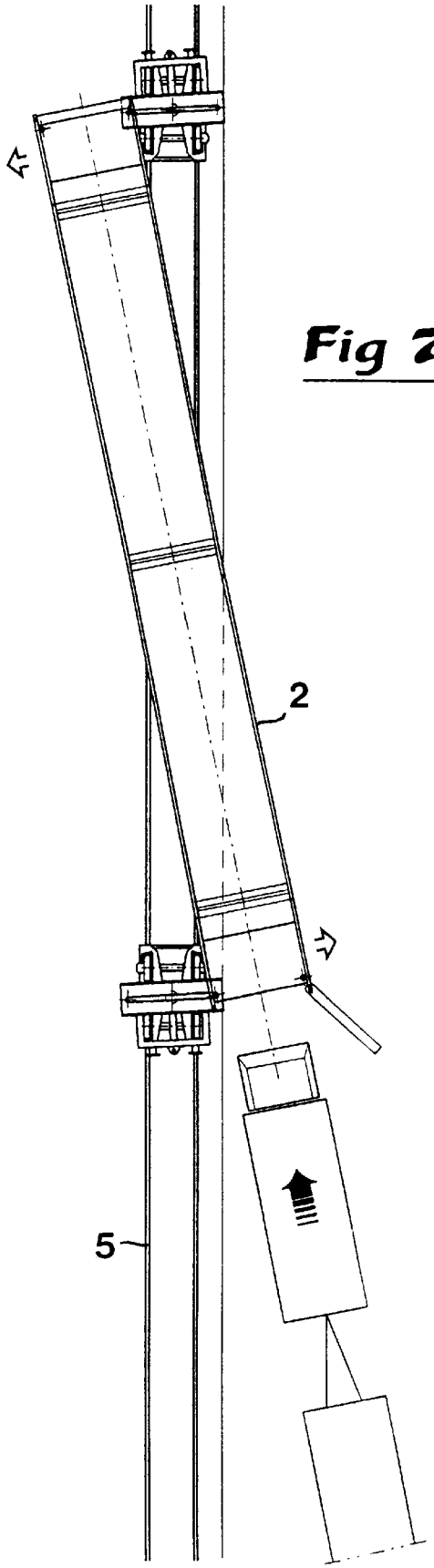

When driving the vehicle on, in accordance with FIG. 6, only one end of the load carrier 2 is displaced laterally, while the other end remains in its given position. This involves that the load carrier is pivoted around the point that is determined by the joint 25 between the bogie 3 and the superjacent intermediate part 6. In FIG. 7 an alternative is shown, according to which both ends of the load carrier are laterally displaced relative to the respective bogies, more specifically in opposite directions relative to these. In this case, the load carrier is pivoted around a central point about midway between the bogies. In the alternative according to FIG. 7, the pivoting angle of the load carrier relative to the track is twice as large as in the case according to FIG. 6.

Figure 8:
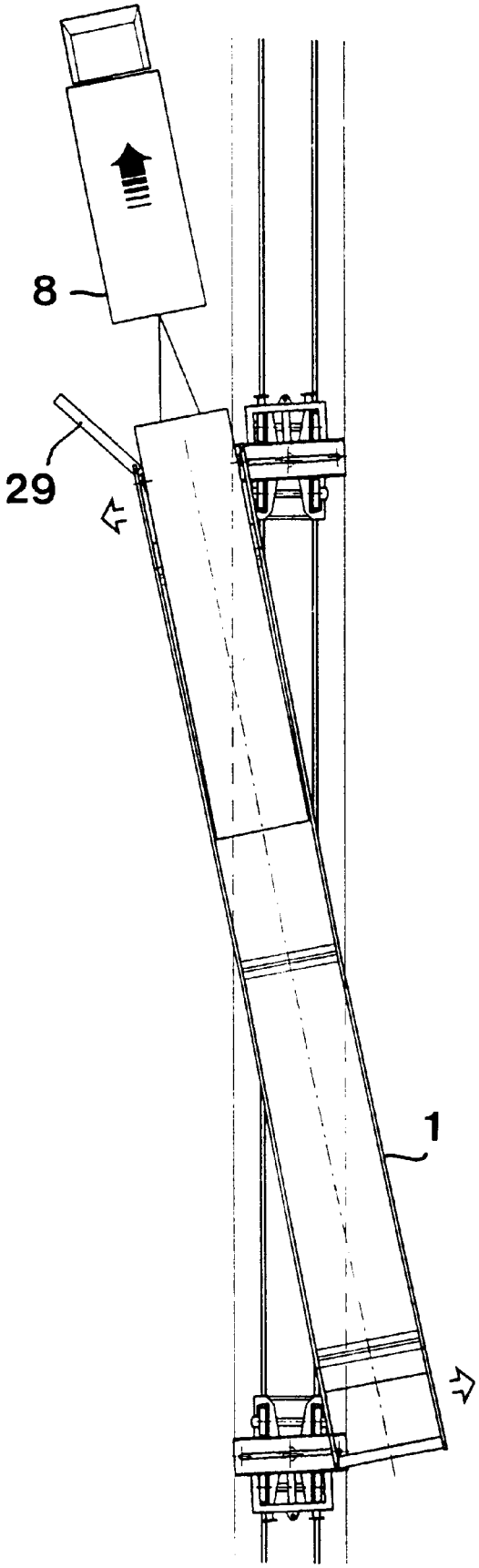

In FIG. 8, it is illustrated how the driving off of the vehicle 8 from the railway waggon may be accomplished in the same direction as when driving it on. This is the case independently of if a lateral displacement of the load carrier is made at both ends (according to FIG. 7) or only at one (according to FIG. 6). In other words, the vehicle does not have to be backed when driving it off; something that is particularly advantageous when it comes to vehicles with coupled trail cars.

Figure 9:
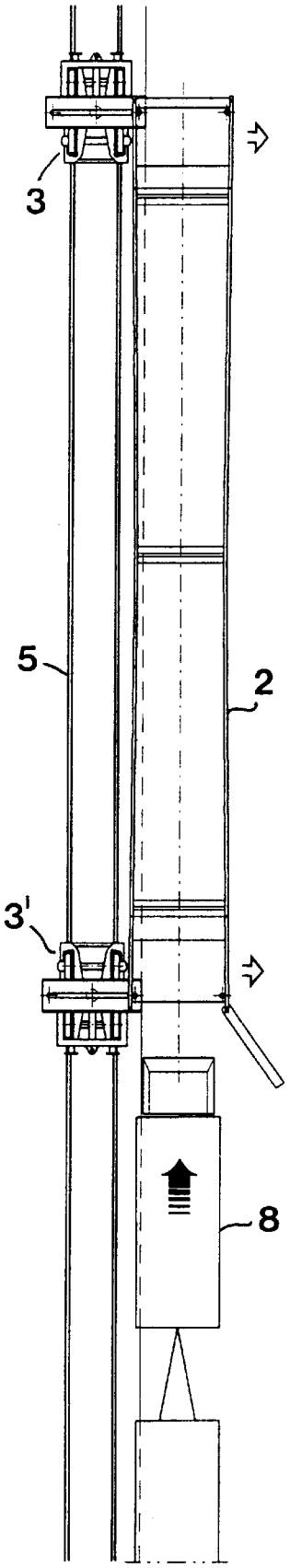

In FIG. 9 is shown how the load carrier 2 may be laterally displaced in the same direction at both ends. In this way, the load carrier may be parallel-displaced laterally relative to the railway track. Then both driving on and off of the road vehicle may be accomplished parallel to the railway track.

Figure 10:
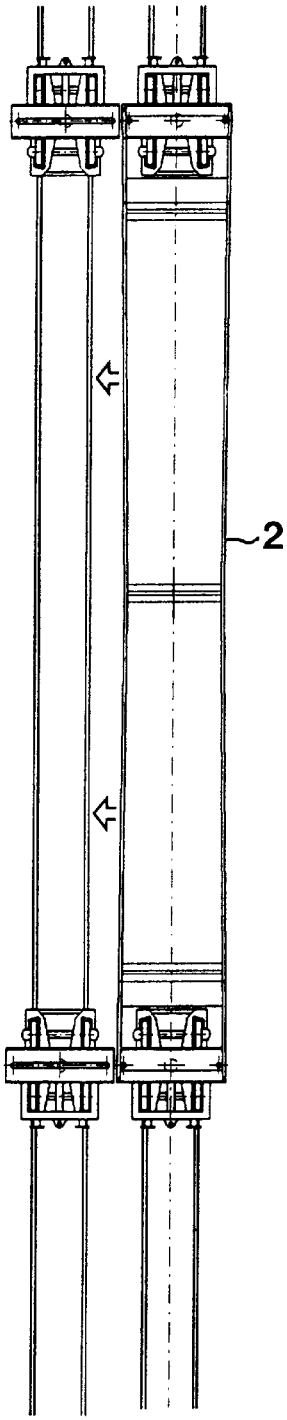

In FIG. 10 is illustrated how the load carrier 2 may, by lateral parallel-displacement, be transferred from its appurtenant bogies on a railway track to two other bogies on a railway track near by. This removal possibility is particularly advantageous in connection wih international transports, when it may be desired to freight load objects through different countries with differing track gauges.

FEASIBLE MODIFICATIONS OF THE INVENTION

The invention is not restricted solely to the embodiment as described and shown in the drawings. Thus, it is feasible to use other means than specifically a chain in order to accomplish the necessary lateral displacement of the end of the load carrier. Nor is the shown cross springer absolutely necessary for the realization of the invention. The essential is that the carrying beams of the load carrier have raised jibs which guarantee that the bottom of the load carrier may be held located on a low level, at the same time as the wheels of the bogies may be made full size, i.e., with the normal diameter. Of course, it is also essential that the load carrier in a suitable way is liberated at each end from the appurtenant bogie, so that it may be laterally displaced relative to the bogie.

I claim:

1. In a railway car having a load carrier (2) with at least two separate carrying beams (12, 12') having opposed ends, said opposed ends of said carrying beams (12, 12') having jibs (15,15') located at a level higher than said carrying beams (12,12')

and load receiving means (13) extending between said beams (12,12') and being located at a level at or below said carrying beams (12, 12'), said car (2) having front and rear bogies (3,3') having wheels (4) associated therewith and having a top portion adapted to receive said jibs (15,15'), said load carrier (2) having means for detachably connecting said bogies to said load carrier (2) whereby in an inactive state relative to loading and unloading of said railway car, said load carrier (2) is laterally displaceable relative to an end thereof along an imaginary geometrical axis extending between said bogies (3,3') to permit displacement of said load carrier (2) to a position spaced from at least one of said bogies (3,3') whereby a vehicle may be driven on and off said load receiving means, the improvement wherein at least one of said bogies includes a transverse intermediate member (6) for supporting said load carrier, said intermediate member being pivotally mounted to said top portion of said at least one bogie by joining means (25,26) to selectively permit rotation on a horizontal plane between said at least one bogie and said load carrier (2) or lateral displacement of said carriers relative to said at least one bogie by sliding contact between said intermediate member and said carrier, said intermediate member (6) including coupling means (7) for coupling said intermediate member (6) to engage corresponding coupling means (7) of an adjacent railway car.

2. A railway car according to claim 1, wherein said transverse intermediate member (6) and means (22,23) for effecting selective rotation or lateral displacement are provided on both of said bogies.

3. A railway car according to claim 1, wherein said jibs (15, 15') have a bottom edge, said bottom edge being positioned above the top edge of said carrying beams (12, 12').

4. A railway car according to claim 1, wherein said intermediate member (6) has an upper portion having a groove (21) at an end portion and wherein said groove (21) opens upwardly and is adapted to receive stop means (34,34'), stop means operatively associated with said jibs (15,15'), said stop means (34,34') being individually movable between a first position in which said stop means (34,34') protrudes downwardly into said end portion of said groove (21) and wherein, in such first position, each said jib (15,15') is prevented from moving in an outward direction from said intermediate means (6), and a second position wherein said stop means (34,34') when removed from said groove (21), are in a non-interfering relationship to prevent movement.

5. A railway car according to claim 4, wherein said intermediate member (6) is a long, narrow lying plate member (19) having longitudinal side edges, said side edges having vertical flanges (20,20') between which said groove (21) and said displacement means (22,22') are located.

6. A railway car according to claim 4, wherein said displacement means comprises at least one endless means (22,22') drivable in opposed directions, and a carrier (23) conveying an end portion of said individual jib resting on said endless means.

7. A railway car according to claim 4, wherein a cross springer (29) is located between said jibs (15,15'), said cross springer (29) having opposed ends which are connected with said jibs by a pair of dowel means (30,30'), one of said dowel means being mobile between an active position in which said dowel means functions as a joint and lock element between a cross springer (29) and an individual jib, and an inactive position in which said dowel means (30,30') liberates a cross springer to permit a pivotable movement of said cross springer (29) around the other of the dowel means (30,30').

* * * * *